US011235448B1

(12) United States Patent
Carnabuci

(10) Patent No.: US 11,235,448 B1
(45) Date of Patent: Feb. 1, 2022

(54) OVERLOAD PROTECTED IMPACT DRIVING DEVICE

(71) Applicant: Apex Brands, Inc., Apex, NC (US)

(72) Inventor: Jon Carnabuci, Columbia, SC (US)

(73) Assignee: Apex Brands, Inc., Apex, NC (US)

( * ) Notice: Subject to any disclaimer, the term of this patent is extended or adjusted under 35 U.S.C. 154(b) by 0 days.

(21) Appl. No.: 17/368,558

(22) Filed: Jul. 6, 2021

Related U.S. Application Data

(60) Provisional application No. 63/075,614, filed on Sep. 8, 2020.

(51) Int. Cl.
*B25B 23/00* (2006.01)
*B25B 21/02* (2006.01)

(52) U.S. Cl.
CPC ..... *B25B 23/0035* (2013.01); *B25B 21/02* (2013.01)

(58) Field of Classification Search
CPC ... B25B 23/0035; B25B 21/02; B25B 23/141; B25B 23/142
See application file for complete search history.

(56) References Cited

U.S. PATENT DOCUMENTS

| | | | |
|---|---|---|---|
| 2,671,484 | A | 3/1954 | Clark |
| 3,630,108 | A | 12/1971 | Stillwagon, Jr. |
| 3,779,038 | A | 12/1973 | Stuemky |
| 3,874,194 | A | 4/1975 | Filepp |
| 4,346,630 | A | 8/1982 | Hanson |
| 4,669,339 | A | 6/1987 | Cartwright |
| 5,180,042 | A | 1/1993 | Ogiso |
| 5,839,518 | A | 11/1998 | Setsuko |
| 5,868,047 | A | 2/1999 | Faust et al. |
| D410,372 | S | 6/1999 | Strauch |
| 6,105,473 | A | 8/2000 | Huang |
| 6,345,560 | B1 | 2/2002 | Strauch |
| 6,684,740 | B2 | 2/2004 | Lin |
| 7,096,768 | B1 | 8/2006 | Chen |
| 7,469,909 | B2 | 12/2008 | Strauch et al. |
| 7,597,031 | B2 | 10/2009 | Chiang |

(Continued)

FOREIGN PATENT DOCUMENTS

| | | | |
|---|---|---|---|
| CN | 1597263 | A | 3/2005 |
| CN | 1898065 | A | 1/2007 |

(Continued)

OTHER PUBLICATIONS

International Search Report and Written Opinion from related international application No. PCT/US2021/049374 dated Sep. 24, 2021.

(Continued)

*Primary Examiner* — David B. Thomas
(74) *Attorney, Agent, or Firm* — Burr & Forman, LLP

(57) ABSTRACT

A torque transfer assembly for a bit holder includes a first lateral member, a second lateral member and a coupling pin. The first and second lateral members extend substantially parallel to each other along opposing sides of an axial channel of a base portion of a drive body of the bit holder. The drive body includes a drive end configured to interface with a powered driver. The coupling pin interfaces between the drive body and a driven body of the bit holder to transfer torque between the drive body and the driven body via engagement between the coupling pin and the first and second lateral members.

20 Claims, 8 Drawing Sheets

(56) References Cited

U.S. PATENT DOCUMENTS

| | | | | |
|---|---|---|---|---|
| D623,036 | S | 9/2010 | DeBaker | |
| 7,810,817 | B1 | 10/2010 | Gao | |
| 8,117,950 | B2 | 2/2012 | Kozak et al. | |
| 8,172,236 | B2 | 5/2012 | Shibata | |
| 8,695,461 | B2 | 4/2014 | Moss et al. | |
| D711,719 | S | 8/2014 | DeBaker | |
| 8,876,120 | B2 | 11/2014 | Chen | |
| 8,955,418 | B2 | 2/2015 | Peters et al. | |
| 9,095,961 | B1 | 8/2015 | Lenfest | |
| 9,107,721 | B2 * | 8/2015 | Plotkin | B25B 23/0035 |
| D752,408 | S | 3/2016 | Moss et al. | |
| 9,283,661 | B2 * | 3/2016 | Cummings | B25B 19/00 |
| D789,761 | S | 6/2017 | Moss et al. | |
| 9,695,882 | B2 * | 7/2017 | Jakoubek | B25B 23/0035 |
| 9,764,452 | B2 | 9/2017 | Koch | |
| 9,943,946 | B2 | 4/2018 | Peters | |
| 10,022,845 | B2 | 7/2018 | Neitzell | |
| 10,166,657 | B2 * | 1/2019 | Cummings | B25B 13/102 |
| 10,245,646 | B2 | 4/2019 | Hu | |
| 10,513,017 | B2 | 12/2019 | Lourenco et al. | |
| 10,991,489 | B2 * | 4/2021 | Schneider | B25B 21/002 |
| 11,059,151 | B2 * | 7/2021 | Cummings | B25B 13/102 |
| 2006/0009297 | A1 | 1/2006 | Hubiak et al. | |
| 2006/0234856 | A1 | 10/2006 | Liu | |
| 2007/0099712 | A1 | 5/2007 | Smihal | |
| 2010/0064860 | A1 | 3/2010 | Kozak et al. | |
| 2011/0036212 | A1 | 2/2011 | Santamarina et al. | |
| 2016/0038210 | A1 * | 2/2016 | Plotkin | A61B 17/8875 606/104 |
| 2016/0325411 | A1 | 11/2016 | Wang | |
| 2020/0215675 | A1 * | 7/2020 | Hawkins | B25B 23/0035 |

FOREIGN PATENT DOCUMENTS

| | | | |
|---|---|---|---|
| CN | 102470516 | A | 5/2012 |
| CN | 102744700 | A | 10/2012 |
| CN | 104786184 | A | 7/2015 |
| CN | 208147717 | U | 11/2018 |
| EP | 2098336 | A3 | 10/2011 |
| WO | 2012049078 | A1 | 4/2012 |
| WO | 2020005805 | A1 | 1/2020 |

OTHER PUBLICATIONS

International Search Report and Written Opinion from related international application No. PCT/CN2019/109788 dated Jun. 24, 2020.

International Search Report and Written Opinion from related international application No. PCT/US2020/061946 dated Feb. 19, 2021.

Non-Final Office Action from related U.S. Appl. No. 17/368,489 dated Oct. 4, 2021.

* cited by examiner

FIG. 1C
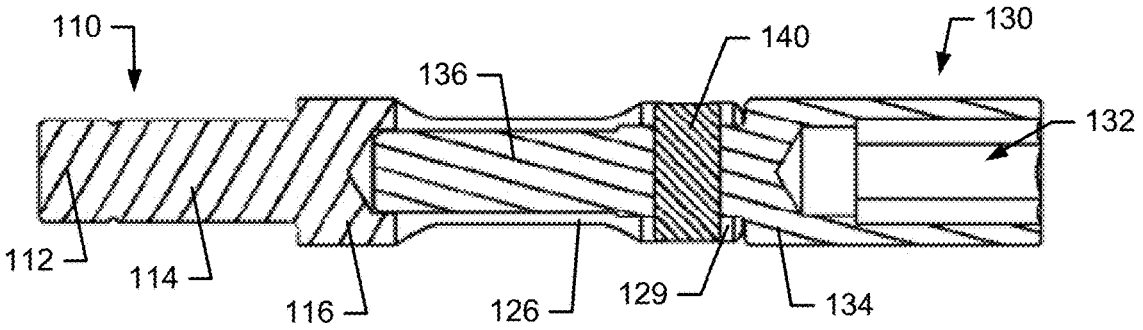
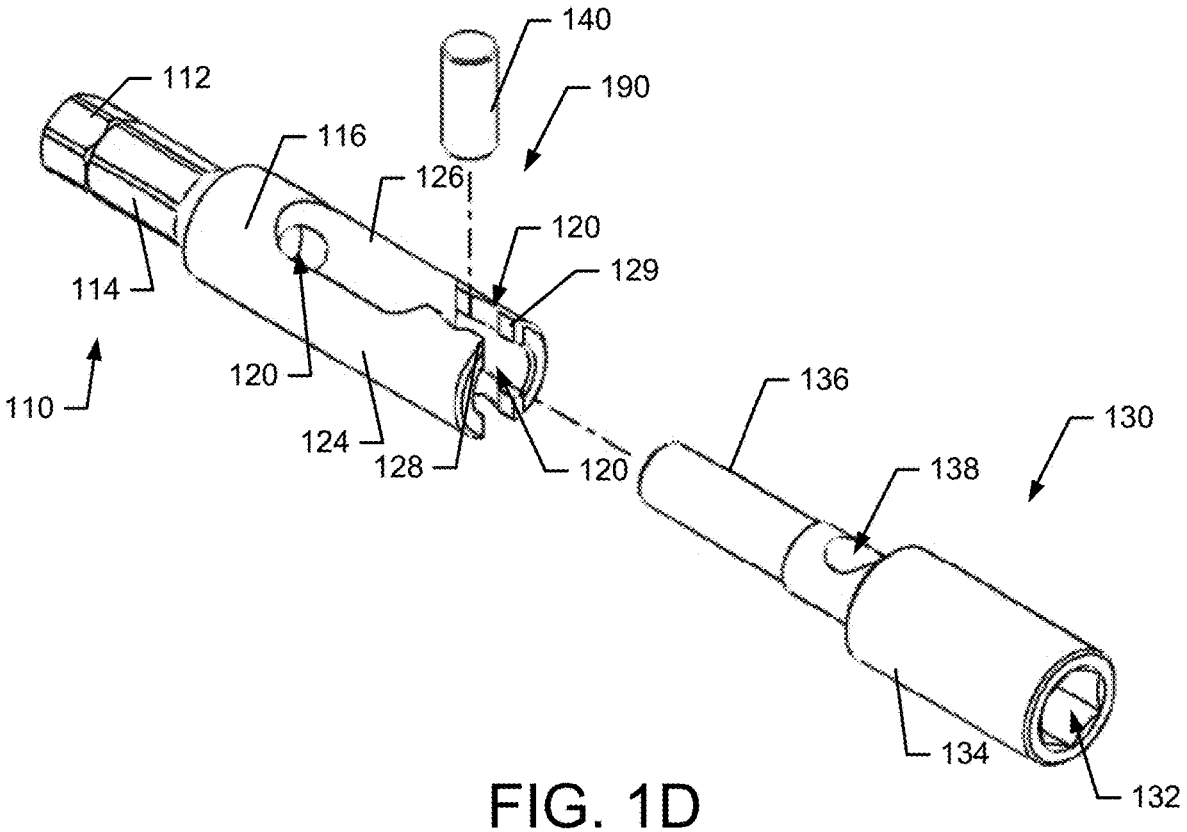
FIG. 1D

FIG. 2C
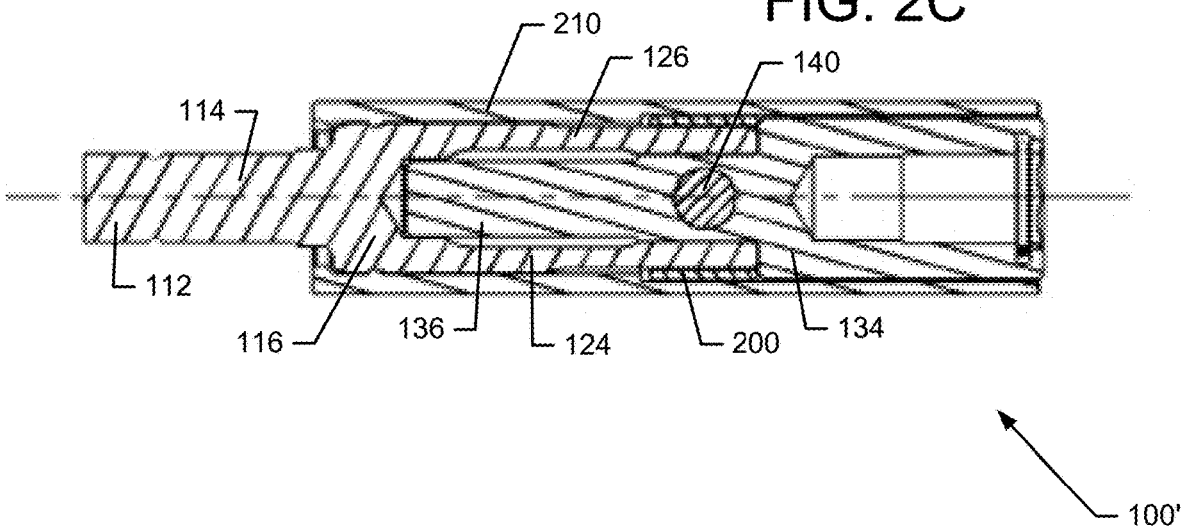
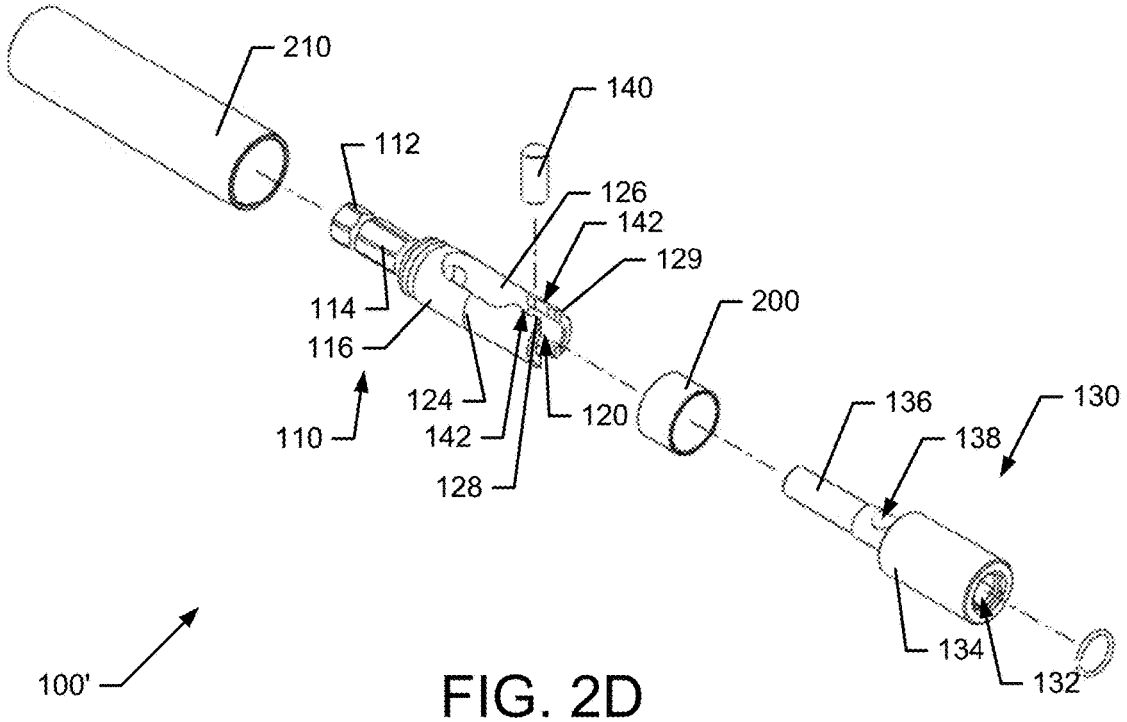
FIG. 2D

FIG. 3A
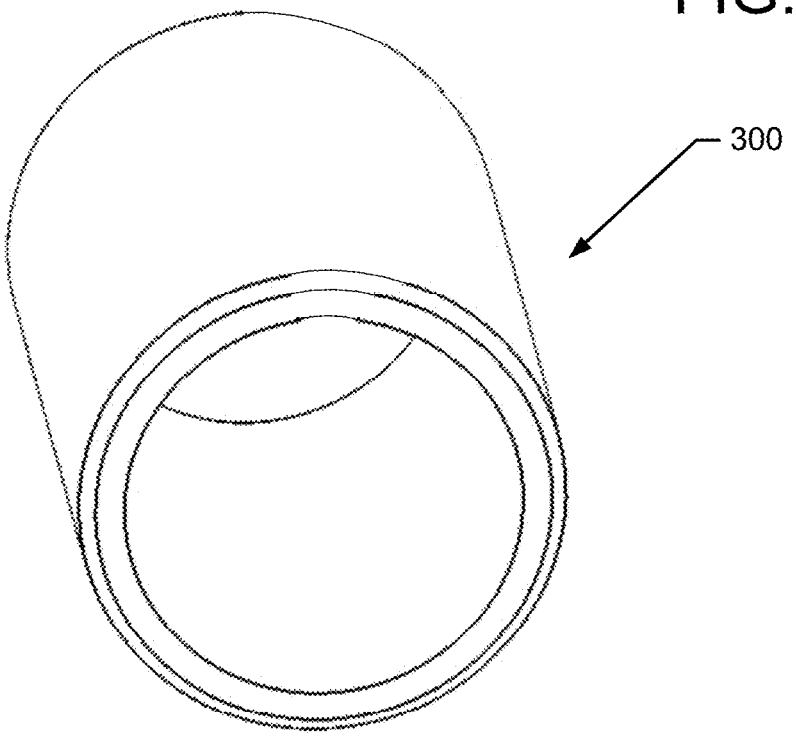
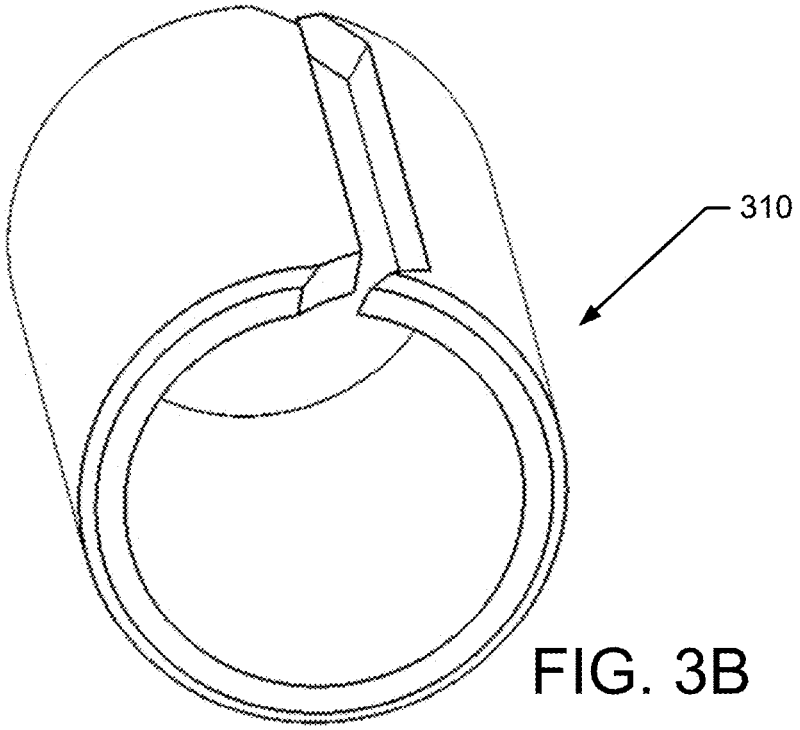
FIG. 3B

FIG. 5
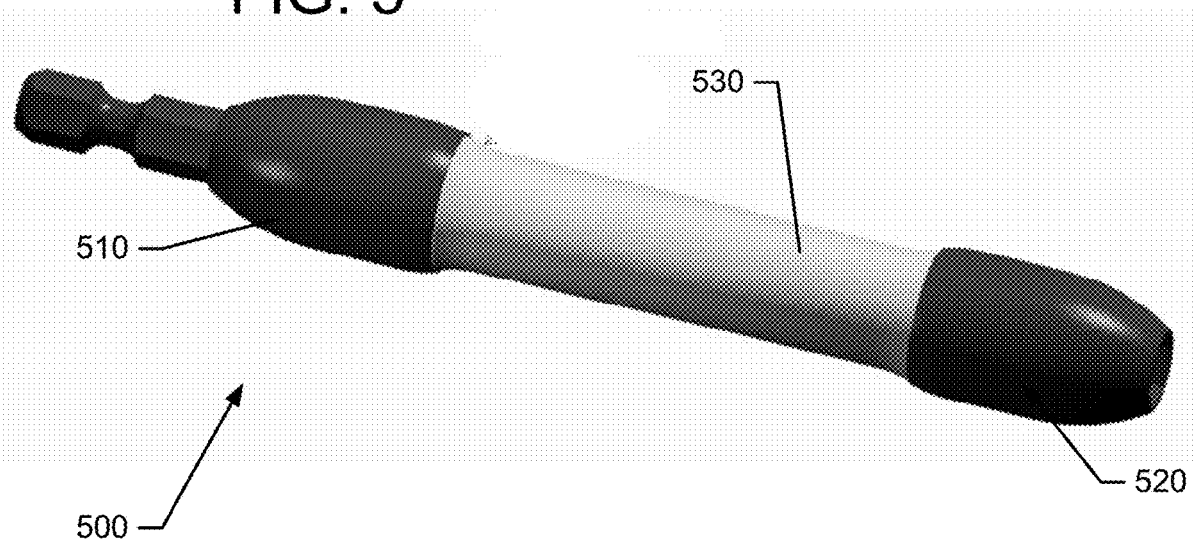
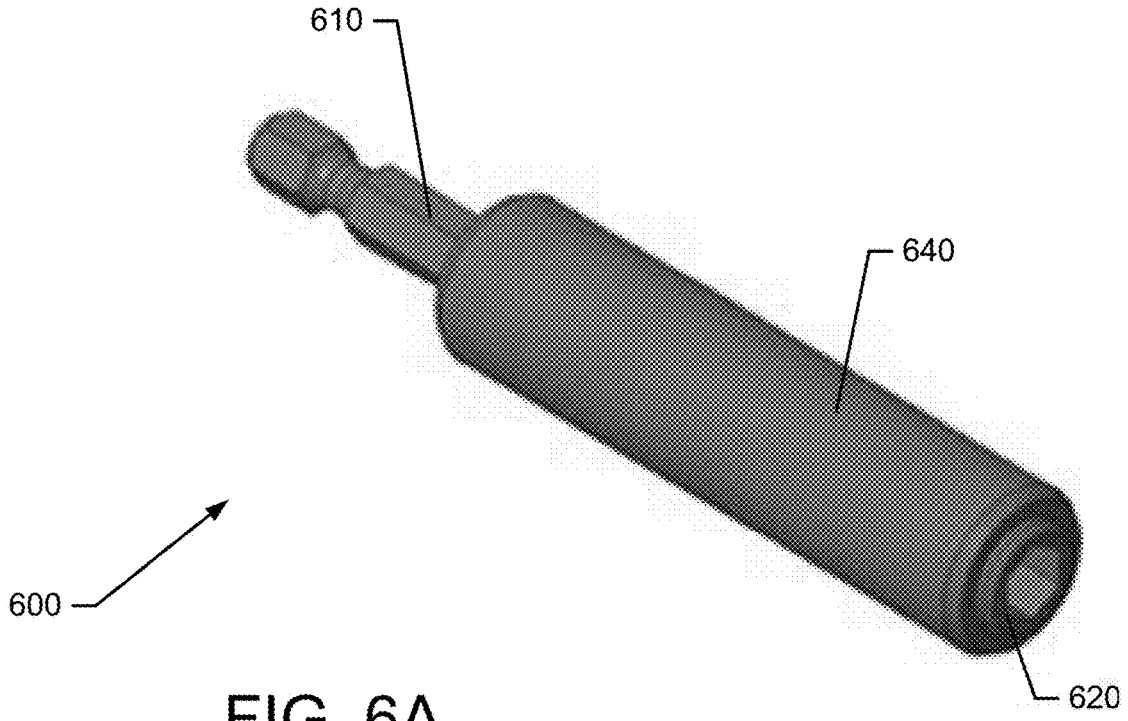
FIG. 6A

FIG. 6B
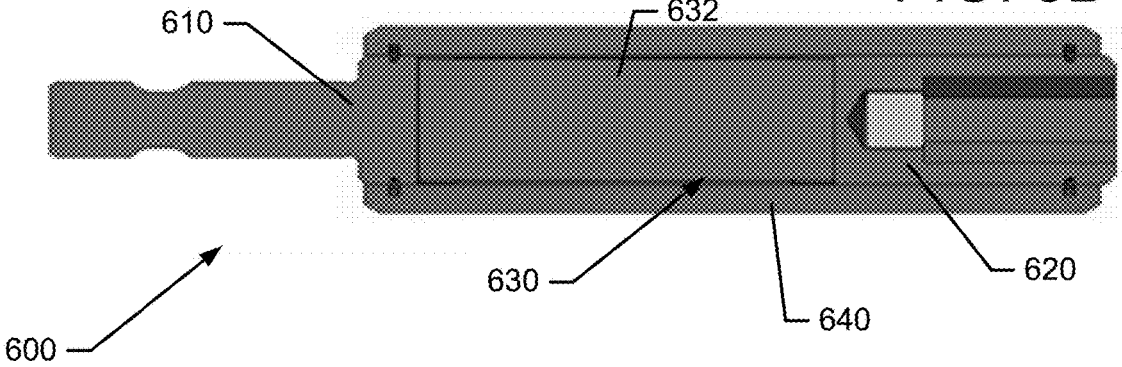
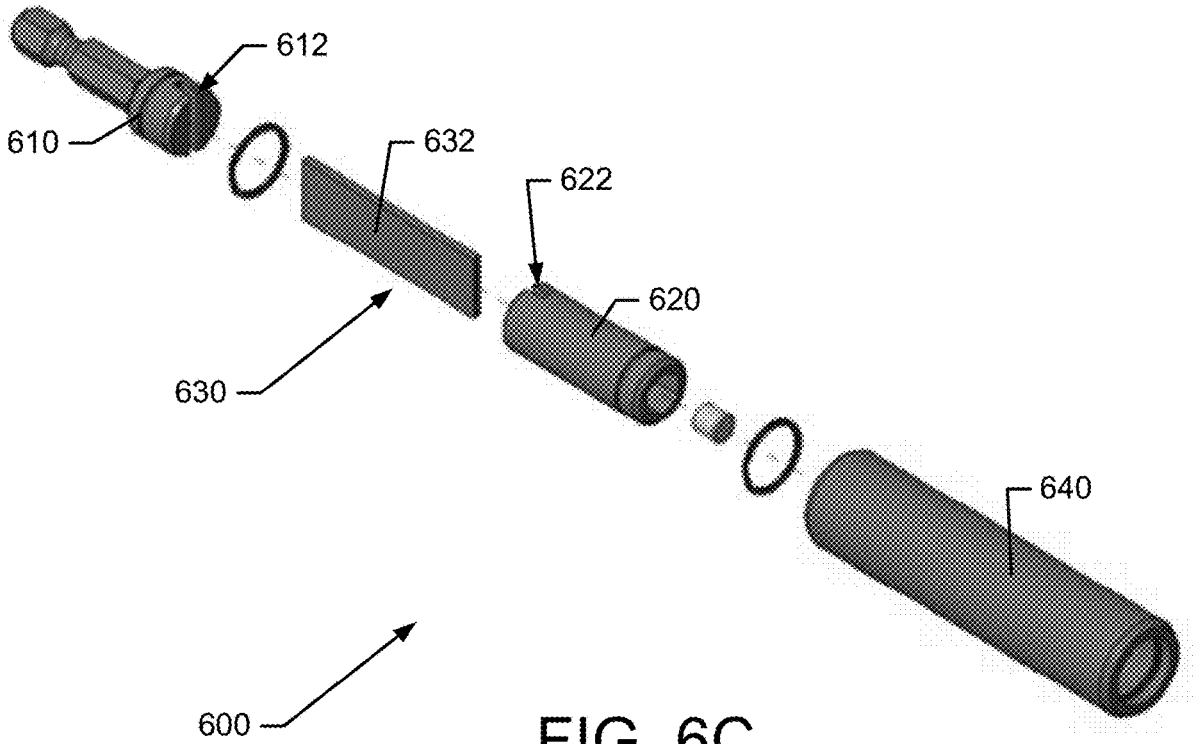
FIG. 6C

OVERLOAD PROTECTED IMPACT DRIVING DEVICE

CROSS-REFERENCE TO RELATED APPLICATIONS

This application claims priority under 35 U.S.C. § 119(e) to U.S. Provisional Application No. 63/075,614, filed Sep. 8, 2020, which is expressly incorporated by reference herein in its entirety.

TECHNICAL FIELD

Example embodiments generally relate to driving devices such as socket tools, bit holders and other fastener driving components. In particular, example embodiments relate to impact drivers, and provide a form of overload protection for impact drivers.

BACKGROUND

Driving devices, such as socket tools and bit holders, are familiar tools for fastening nuts and driving other drivable components or fasteners. Bit holders, for example, often have a drive end that includes a conventional interface for receiving drive energy from a powered driving device. The drive end may have a standard sized hex head or another conventional power bit drive end geometry. The bit holder may also include a driven end, which is driven by the rotational force applied by the powered driving device at the drive end, and which in turn applies drive energy to a bit. The bit may be received in a hex shaped socket, or any other bit holding geometry that defines a receptacle for the bit.

Bits of various sizes and shapes may have standard (e.g., hex) heads that enable any of the various different bits to interchangeably be inserted into the bit holder. Thus, by attaching the bit holder to the powered driving device (e.g., via a chuck of the powered driving device), any number of different bits can quickly and easily be substituted to meet each situation that is encountered. Because high torque is often applied through these tools, and high strength and durability is desirable, the bit holders are traditionally made of a metallic material such as iron or steel.

Impact drivers are typically employed to apply high and sudden torque to fasteners. The high and sudden torque application made possible by these devices may be particularly useful for loosening of frozen or over-torqued fasteners. However, the application of high and sudden torque may also be useful for applying a high torque to a fastening device that is being used in a context that requires a high input torque. In either case, if a bit holder is used with an impact driver, and the bit holder is rigidly made of metallic materials, the suddenness of the application of force by the powered driving device is equally suddenly applied through the bit holder and to the bit, which could damage the bit, the fastener, or even the bit holder. Thus, it may be desirable to improve bit holder design to lengthen the useful life of driver bits and bit holders.

BRIEF SUMMARY OF SOME EXAMPLES

Some example embodiments may enable the provision of a bit driver that includes a driven end and drive end that are operably coupled to each other via a torque transfer mechanism that, although still applying full impact energy, ensures that loads through the bit holder (and the bit) are not absorbed or dissipated entirely. Thus, high hardness driver bit life can be considerably lengthened.

In an example embodiment, an elastic torque transfer assembly for a bit holder is provided. The elastic torque transfer assembly for a bit holder includes a first lateral member, a second lateral member and a coupling pin. The first and second lateral members extend substantially parallel to each other along opposing sides of an axial channel of a base portion of a drive body of the bit holder. The drive body includes a drive end configured to interface with a powered driver. The coupling pin interfaces between the drive body and a driven body of the bit holder to transfer torque between the drive body and the driven body via engagement between the coupling pin and the first and second lateral members.

In another example embodiment, an impact bit holder may be provided. The impact bit holder may include a drive body having a drive end configured to interface with a powered driver, and a driven body having a driven end configured to interface with a bit. The drive body includes a base portion. The base portion of the drive body interfaces with a coupling pin that interfaces between the drive body and the driven body at an elastic torque transfer assembly configured to transfer torque between the drive body and the driven body via the coupling pin.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

FIG. 1C is a cross section view of the bit holder taken along line A-A' of FIG. 1B in accordance with an example embodiment;

FIG. 1D is an exploded view of the bit holder of FIG. 1A in accordance with an example embodiment;

FIG. 2C is a cross section view taken through a plane that is substantially perpendicular to the plane defining the cross sectional view of FIG. 2B in accordance with an example embodiment;

FIG. 2D is an exploded perspective view of the bit holder of FIG. 2A in accordance with an example embodiment;

FIG. 3A is a perspective view of a continuous retaining ring in isolation according to an example embodiment;

FIG. 3B is a perspective view of a split dowel retaining ring in isolation according to an example embodiment;

FIG. 5 is a perspective view of a torque transfer assembly that physically separates a drive body and driven body axially according to an example embodiment;

FIG. 6A is a perspective view of a bit holder with another alternative structure according to an example embodiment;

FIG. 6B is a cross section view taken along a longitudinal centerline or axis of the bit holder of FIG. 6A according to an example embodiment; and FIG. 6C illustrates an exploded view of the bit holder of FIG. 6A according to an example embodiment.

DETAILED DESCRIPTION

Figure 1A:
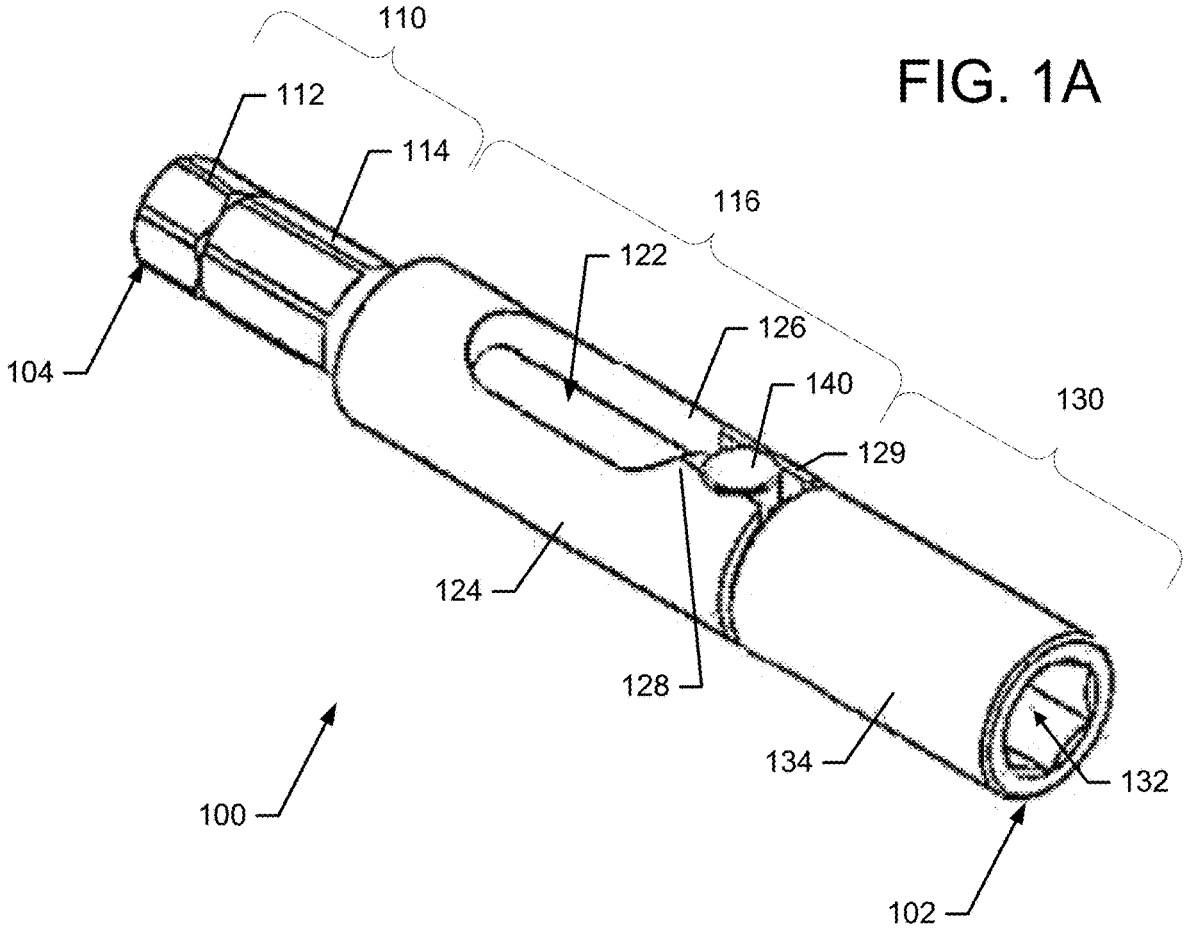
FIG. 1A illustrates a perspective view of a bit holder according to an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

As indicated above, some example embodiments may relate to the provision of driving tool such as a bit holder that can be used with impact drivers. In an example embodiment, the driving tool (which will be described as a bit holder to illustrate one example) may be constructed in such a way as to prevent the bit holder from absorbing and dissipating all of the torque load applied thereto within the metal shaft or core of such device. Instead, a structure is employed that strategically distributes forces within the device without reducing the overall impact energy that can be delivered through the device. For example, the bit holder described herein may include a drive end and a driven end that are made separately, and that do not couple torque therebetween directly. Instead, the drive end and the driven end are operably coupled to each other via an elastic torque transfer assembly. Some structures that can employ example embodiments will now be described below by way of example and not limitation.

Figure 1B:
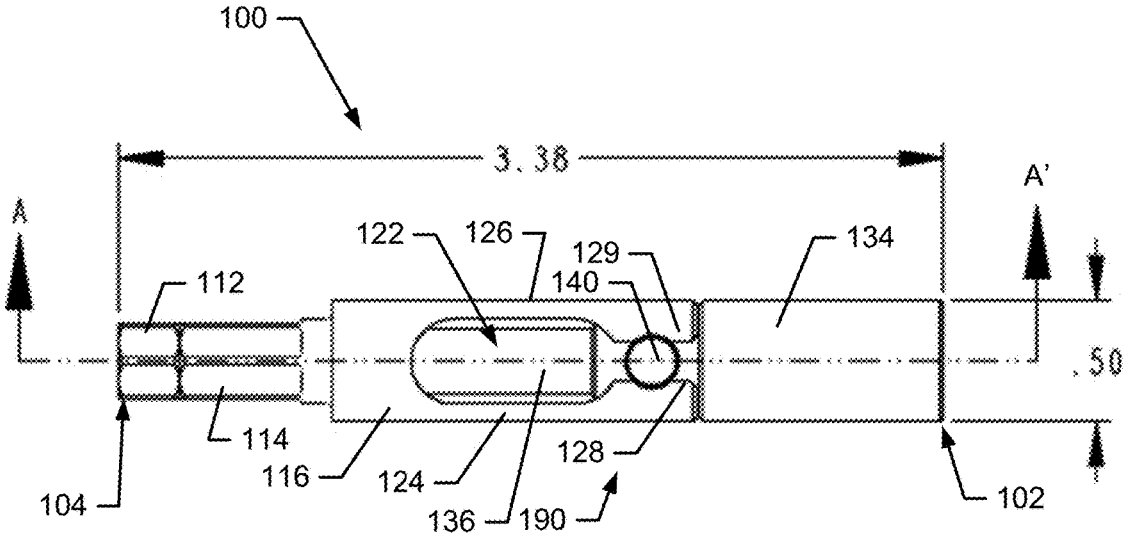
FIG. 1B is a top view of the bit holder of FIG. 1A in accordance with an example embodiment.

FIG. 1A illustrates a perspective view of a bit holder 100 according to an example embodiment. FIG. 1B is a top view of the bit holder 100 of FIG. 1A. FIG. 1C illustrates a cross section view taken along line A-A' in FIG. 1B, and FIG. 1D is an exploded perspective view of the bit holder 100. The bit holder 100 may be defined by a driven end 102 and a drive end 104, which are each separate components that are operably coupled together via an elastic torque transfer assembly 190 of an example embodiment.

As noted above, the drive end 104 is configured to interface with a powered driving device and the driven end 102 is configured to interface with a bit. The drive end 104 may include a drive body 110. The drive body 110 may include or be defined by a hex head 112 and shaft 114 that are coaxial with each other and a base portion 116. The base portion 116 may be a substantially cylindrical body that includes an axial channel 120 and a lateral channel 122 that each extend from a distal end of the drive body 110 (relative to the hex head 112) toward the shaft 114. The axial channel 120 may be bored (or formed) as a cylindrical channel that aligns with an axis of the bit holder 100. Meanwhile, the lateral channel 122 may divide the base portion 116 into lateral members 124 and 126 that face each other about the lateral channel 122. The lateral members 124 and 126 may therefore appear as respective prongs or tines of a tuning fork, which the base portion 116 may resemble after the axial channel 120 and lateral channel 122 are formed or cut therein. The shape of the lateral channel 122 may be constant or variable along its length. In the pictured example, the lateral channel 122 may have an expanded width at a portion thereof that is spaced apart from the distal end. Moreover, the expanded width of the lateral channel 122 in this portion may actually render the axial channel 120 discontinuous, existing only at a distal and proximal ends of the base portion 116. However, other structures are also possible.

In this example, the distal end of the base portion 116 may include shoulders that extend toward each other on opposing sides of the lateral channel 122 and the axial channel 120. In this regard, a first shoulder 128 may be formed on one of the lateral members 124 and a second shoulder 129 may be formed on the other of the lateral members 126.

The driven end 102 may include a driven body 130. The driven end 102 may be configured to interface with the bit in order to drive the bit responsive to the application of torque by the powered driving device to the drive end 104. The driven body 130 may include a hex socket 132 and socket body 134 that are coaxial with each other and a coupling rod 136. The base rod 136 may be a cylindrical body that is shaped to fit into the axial channel 120 of the drive body 110. Thus, the base rod 136 may have a length that is about equal to the length of the axial channel 120, and an outer diameter that is about equal to the inner diameter of the axial channel 120 (at least at the shoulders 128 and 129). The base rod 136 may therefore extend between the lateral members 124 and 126, and the lateral members 124 and 126 may contact the outer peripheral edges of the base rod 136 at least at a distal end thereof and, in some cases, along their entire lengths.

The base rod 136 may also include a radial channel 138 formed in a portion of the base rod 136 that is proximate to the socket body 134. A coupling pin 140 may be configured to fit into the radial channel 138, and may have a longitudinal length that is substantially equal to the outer diameter of the base portion 116 of the drive body 110 and/or the outer diameter of the socket body 134 of the driven body 130. The shoulders 128 and 129 may each have a groove 142 formed therein, which is configured to engage peripheral edges of the coupling pin 140. The coupling pin 140 of this example therefore extends in a transverse direction, which is substantially perpendicular to the longitudinal axis (or axial direction) of the bit holder 100.

The coupling pin 140, which is disposed in the radial channel 138 of the base rod 136, and the shoulders 128 and 129 of the lateral members 124 and 126 may form the elastic torque transfer assembly 190 in this example embodiment. As such, the base portion 116 of the drive body 110 (of which the lateral members 124 and 126 are part) may be said to elastically engage the coupling pin 140 to form the elastic torque transfer assembly. Assembly of these components may be relatively straightforward, but may provide a flexible coupling that protects the bit holder 100. In this regard, for example, the base rod 136 may be inserted into the axial channel 120 until a distal end of the lateral members 124 and 126 abuts or is proximate to the socket body 134. The socket body 134 may then be rotated within the axial channel 120 until the radial channel 138 substantially aligns with the grooves 142 formed in the shoulders 128 and 129 of the drive body 110. The coupling pin 140 may then be inserted through the radial channel 138 to also contact the shoulders 128 and 129 (e.g., at the grooves 142 thereof). In some cases, the coupling pin 140 may be press fit into position. The insertion of the coupling pin 140 into the radial channel 138 completes formation of the elastic torque transfer assembly 190 of this example. However, it will be appreciated that other structures could also be employed to perform the same desired function of providing some elasticity in the coupling between the drive body 110 and the driven body 130.

When the elastic torque transfer assembly 190 is formed, a torque (e.g., an instantaneously applied high amount of torque from an impact driver) applied at the drive end 102 will correspondingly apply torque to the base portion 116 (e.g., via the hex head 112 and shaft 114). The lateral members 124 and 126 will therefore be carried along with the base portion 116 to rotate the shoulders 128 and 129, which contact the coupling pin 140 and apply rotational force thereto. The rotation of the coupling pin 140 may correspondingly carry the driven body 130 in rotation via the coupling pin 140 interfacing with the base rod 136, thereby also applying rotational force to turn the socket body 134 and the hex socket 132.

If the hex socket 132 is assumed to be in contact with a fastener or bit engaged with a fastener, it can be appreciated that the driven body 130 transfers the rotational torque to the fastener or bit. If the fastener is in a context that causes the fastener to resist rotation, a normal bit holder would have to dissipate all of the impact torque in the metal structure of the bit holder, and the bit holder could fail. However, the elastic torque transfer assembly 190 of this example embodiment will allow the maximum torque to still be transferred to the fastener, but will provide enough flexing capability for the bit holder 100 to dramatically reduce the likelihood of component failure. In this regard, for example, the lateral members 124 and 126 may be enabled to flex apart from each other slightly while still transferring rotational torque to the coupling pin 140. The flexion of the lateral members 124 and 126 can allow torque transfer to the driven body 130 with less peak instantaneous stress being imparted on the components of the bit holder 100.

Of note, FIG. 1B illustrates dimensional measurements for length (e.g., 3.38 inches) and diameter (e.g., 0.5 inches) for the bit holder 100. However, these measurements should be understood to merely be examples, and other designs may employ different dimensions. Moreover, in some cases, the dimensions could simply be scaled up or down to accommodate different hex socket 132 sizes.

In some cases, it may be desirable to limit the amount of flexion that is permitted for the lateral members 124 and 126. Material selection (which is typically steel) and the thickness of the lateral members 124 and 126 may play a significant role in determining the amount of flexion that is permitted. However, other movement restrictors may be employed in some cases. FIGS. 2A, 2B, 2C and 2D illustrate another example embodiment, which includes examples of some movement restriction options.

Figure 2A:
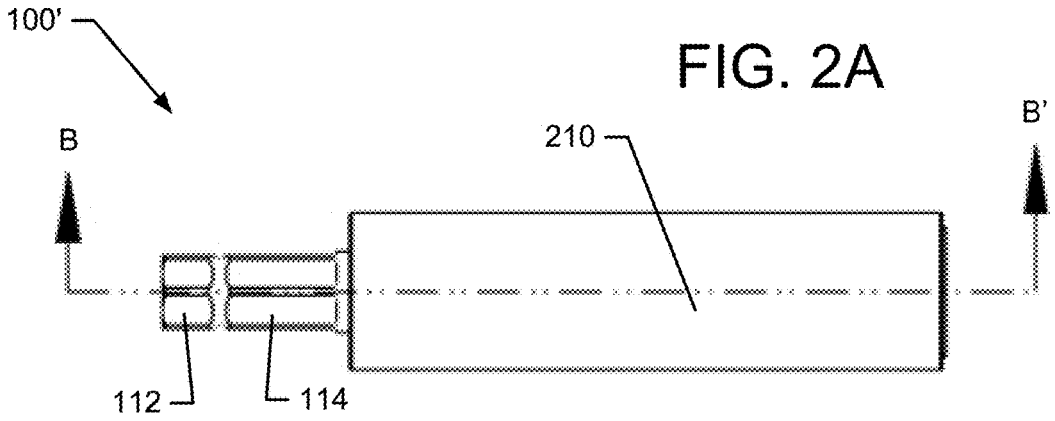
FIG. 2A illustrates a top view of a bit holder according to another example embodiment.
Figure 2B:
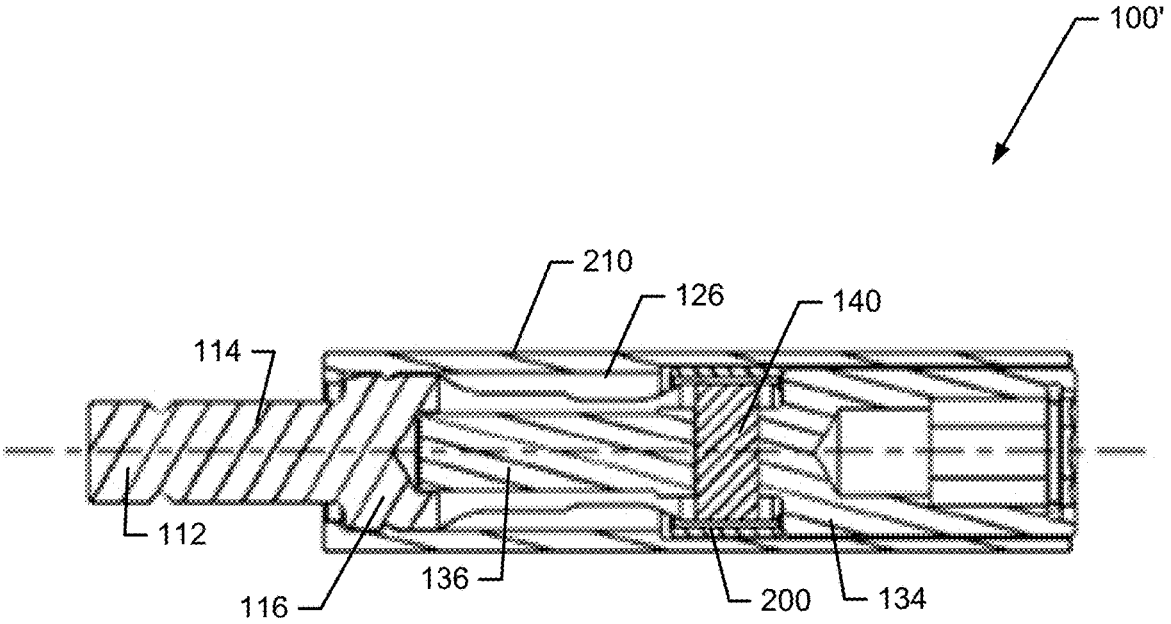
FIG. 2B illustrates a cross section view taken along line B-B' in FIG. 2A in accordance with an example embodiment.

In this regard, for example, FIG. 2A illustrates a top view of a bit holder 100' according to an example embodiment. FIG. 2B illustrates a cross section view taken along line B-B' in FIG. 2A, and FIG. 2C is a cross section view taken through a plane that is substantially perpendicular to the plane defining the cross sectional view of FIG. 2B. FIG. 2D is an exploded perspective view of the bit holder 100'. In FIGS. 2A-2D, the bit holder 100' may have the same structures described above in reference to the bit holder 100 of FIGS. 1A-1D. However, the bit holder 100' of FIGS. 2A-2D may further include additional structures or components as described herein.

In an example embodiment, a retaining ring 200 and/or sleeve 210 may be added to the bit holder 100 of FIGS. 1A-1D in order to provide the bit holder 100' of FIGS. 2A-2D. The retaining ring 200 (if employed) may be disposed to extend around the distal ends of the lateral members 124 and 126. The retaining ring 200 may have an inner diameter that is slightly larger than an outer diameter of the lateral members 124 and 126 in a no load condition (i.e., when no torque is applied to the drive end 102). When torque is applied to the drive end 102, the lateral members 124 and 126 may be allowed to flex at least until contact is initiated with the retaining ring 200. As such, the retaining ring 200 may provide an outer limit, or at least provide additional structure to resist movement (i.e., flexion) of the lateral members 124 and 126 beyond a threshold amount of movement (e.g., defined by the gap between the retaining ring 200 and the lateral members 124 and 126 or by the amount of play the retaining ring 200 allows by virtue of its structure). The retaining ring 200 may therefore, in some embodiments, define a limit for the elasticity of the elastic torque transfer assembly 190 by defining the maximum amount of lateral or axial movement that the lateral members 124 and 126 can have away from the longitudinal axis of the bit holder 100'.

The sleeve 210 (or shell) may be made of a composite material, resin, or the like. The sleeve 210 may therefore provide some resistance to the spreading of the lateral members 124 and 126 even when the retaining ring 200 is not in use. However, if the retaining ring 200 is in use, the sleeve 210 may also limit expansion of the retaining ring 200 (e.g., if the retaining ring 200 is configured to flex itself such as may be the case when the retaining ring 200 is not an endless or continuous ring 300 as shown in FIG. 3A, but is instead a split dowel 310 as shown in FIG. 3B). Thus, the retaining ring 200 and the sleeve 210 may each be parts of the elastic torque transfer assembly 190 of some example embodiments. In some embodiments, the retaining ring 200 provides resistance to the spreading of the lateral members 124 and 126, while the sleeve 210 does not provide resistance to the spreading of the lateral members 124 and 126 but instead the sleeve 210 is configured to rotate freely with respect to the driven body 130. In any case, the sleeve 210 may be provided to insulate the bit holder 100' electrically and/or prevent galling of either the bit holder 100' or other components the bit holder 100' may contact during usage.

As can be appreciated from FIGS. 1A-2D, the bit holders 100 and 100' may be configured to allow for the drive member 110 and the driven member 130 to effectively transfer torque therebetween, but do so in a way that reduces the maximum instantaneous torque that is experienced in the bit holders 100 or 100'. In this regard, the elastic torque transfer assembly 190 flexibly couples the drive member 110 to the driven member 130 such that a small amount of play is provided therebetween when under significant load. By including the small amount of play, and by the elasticity provided by the elastic torque transfer assembly 190, although the same torque is ultimately passed from the drive body 110 to the driven body 130, the forces are distributed through the structures of the bit holder 100/100' in a less concentrated way, thereby improving the durability and lessening the chances of component failure for the bit holder 100/100' over time.

In an example embodiment, the drive body 110, the driven body 130, and other internal components may be made of the same type of metallic material (e.g., steel or various alloys thereof). Meanwhile, the sleeve 210 may be made of a scratch resistant or decorative material (e.g., plastics, nylon, or other moldable materials). However, the sleeve 210 of some embodiments could also be designed to be load bearing.

Figure 4A:
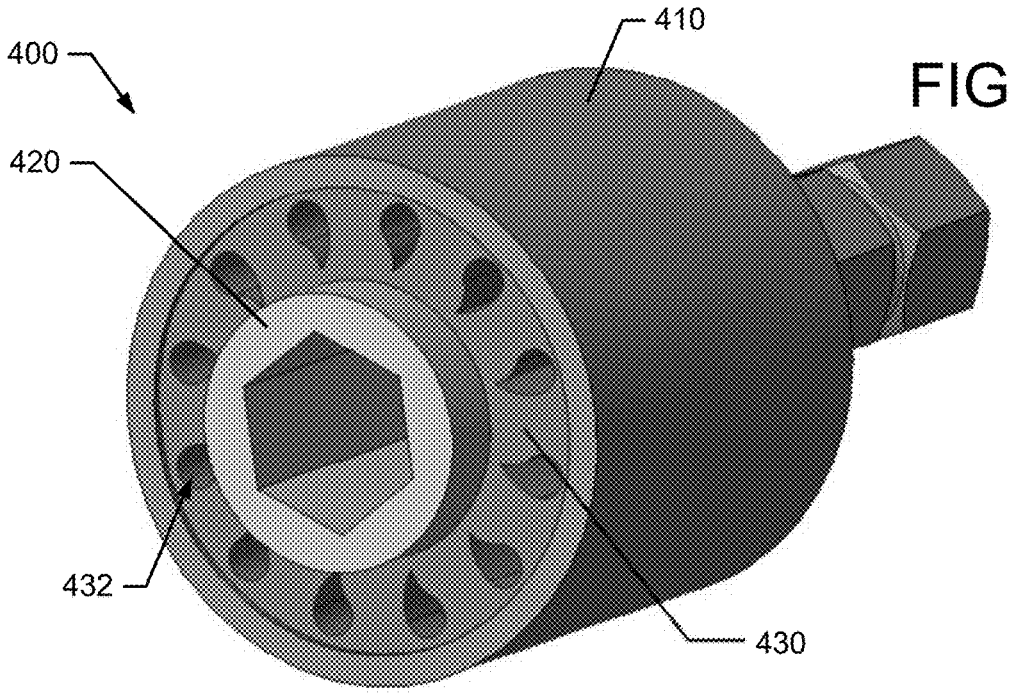
FIG. 4A is a cross section view of an alternative torque transfer assembly according to an example embodiment.
Figure 4B:
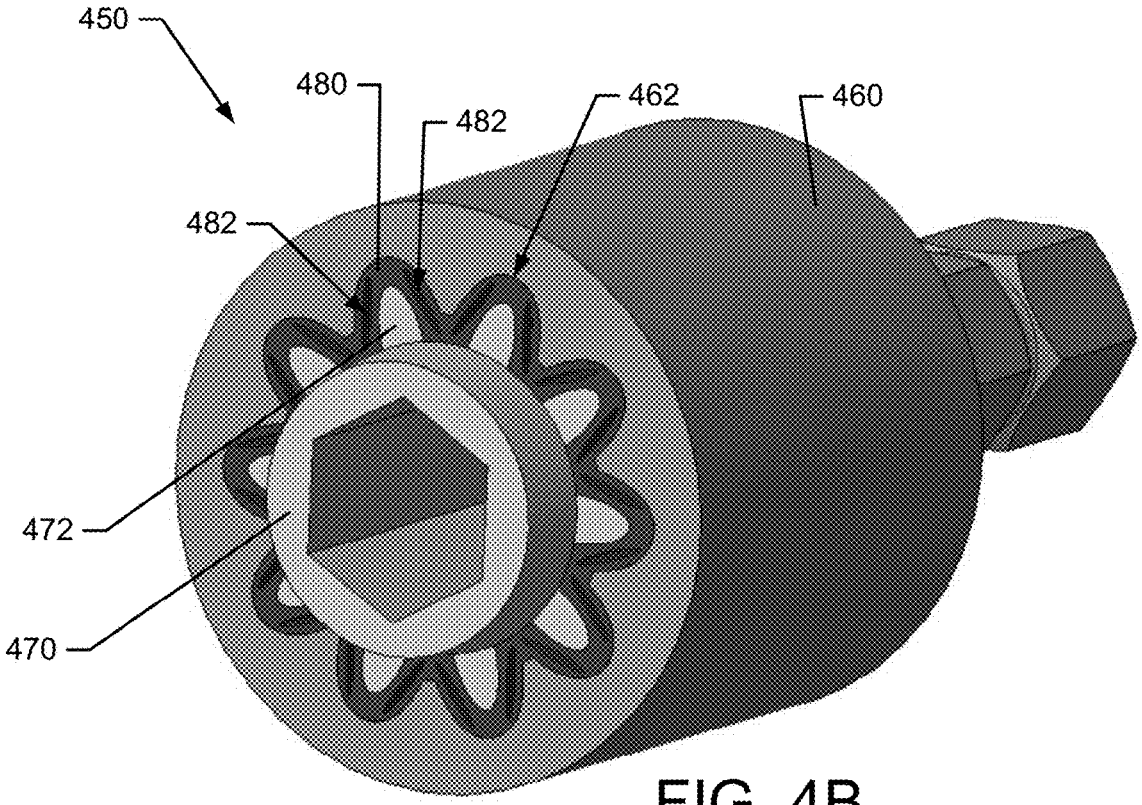
FIG. 4B is a cross section view of another alternative torque transfer assembly according to an example embodiment.

It should also be appreciated that the torque transfer assembly could take different forms. For example, as shown in FIGS. 4A and 4B, the torque transfer assembly may be provided in the form of a high energy elastomer with unique shapes used to provide an interface between a drive body and a driven body. In this regard, FIG. 4A illustrates a bit holder 400 configured to operably couple a drive body 410 to a driven body 420 via an elastomeric member 430. The elastomeric member 430 may have grooves, ridges or other structures that are configured to interface with each of the drive body 410 and the driven body 420 to retain the elastomeric member 430 between the drive body 410 and the driven body 420 to transfer torque therebetween. However, the elastomeric member 430 may include deformation chambers 432 disposed therein to allow some small amount of deformation of the elastomeric member 430 in response to high and sudden torque inputs. In this regard, the deformation chambers 432 may enable some amount of flexion of the elastomeric member 430 in a radial direction responsive to the high and sudden torque being applied when the deformation chambers 432 change shape to accommodate. The shape of the deformation chambers 432 (i.e., tear drop shaped) contributes to the flexing capability thereof.

In the example of FIG. 4B, a slightly different approach is employed. In the example of FIG. 4B, a bit holder 450 is again configured to operably couple a drive body 460 to a driven body 470 via an elastomeric member 480. However, in this example, an outer periphery of the driven body 470 is provided with shaped ridges 472 that substantially match the shape of corresponding valleys 462 formed in the drive body 460. Meanwhile, the elastomeric member 480 is formed in a gap between the drive body 460 and the driven body 470 to transfer torque therebetween. The elastomeric member 480 includes deformation chambers 482 disposed therein to allow some small amount of deformation of the elastomeric member 480 in response to high and sudden torque inputs. In this regard, the deformation chambers 482 may be disposed between each adjacent surface of the ridges 472 and valleys 462 and compress slightly enable some amount of flexion of the elastomeric member 480 in a radial direction responsive to the high and sudden torque being applied.

In the examples of FIGS. 4A and 4B, the elastomeric member 430/480 is disposed between overlapping (along the axial direction) sections of the drive body 410/460 and the driven body 420/470. However, the torque transfer assembly could also or alternatively be disposed between non-overlapping drive and driven bodies as well. In this regard, for example, FIG. 5 illustrates a bit holder 500 configured to operably couple a drive body 510 to a driven body 520 via a thermoplastic coupler 530. The thermoplastic coupler 530 may have grooves, ridges or other structures that are configured to interface with each of the drive body 510 and the driven body 520 to retain the thermoplastic coupler 530 between the drive body 510 and the driven body 520 to transfer torque therebetween. However, as shown in FIG. 5, the driven body 520 and the drive body 510 may otherwise not have any overlap in the axial direction. In other words, the thermoplastic coupler 530 may be disposed in a gap region that physically separates the drive body 510 and driven body 520 axially from each other. The thermoplastic coupler 530 may be made of a polyamide-imide such as Torlon® or similar materials that are noted for having exceptional mechanical, thermal and chemical resistance properties. As with the examples above, a sleeve or shell may also be included over the bit holder 500 portions shown in FIG. 5.

Still other strategies may also be employed. For example, FIG. 6A is a perspective view of a bit holder 600 with another alternative structure according to an example embodiment. FIG. 6B is a cross section view taken along a longitudinal centerline or axis of the bit holder 600, and FIG. 6C is an exploded view of the bit holder 600. The bit holder 600 includes a drive body 610 and a driven body 620 that are again separated from each other along the axial direction. In particular, the drive body 610 and driven body 620 are separated from each other axially by elastic torque transfer assembly 630. The elastic torque transfer assembly 630 includes a plate member 632 having a rectangular plate shape, which extends between a first slot 612 formed in the drive body 610 and a second slot 622 formed in the driven body 620. In some cases, a shell or sleeve 640 may be provided over the plate member 632 and the sleeve 640 could be molded to also fill in around lateral edges of the plate member 632 to form a cylindrical body around the bit holder 600. As can be appreciated from FIGS. 6A, 6B and 6C, when a sudden and/or high torque is applied to the drive body 610, the plate member 632 may flex somewhat while transferring the torque to the driven body 620. The flexion of the plate member 632 may enable the full torque to be transmitted, but slow the application thereof similar to the examples described above.

The torque transfer assembly of some example embodiments may include dual functions of holding the drive body 110 and the driven body 130 in proximity to each other axially and of transferring (or communicating) torque from the drive body 110 to the driven body 130. These two functions may be performed by the elastic nature of the elastic torque transfer assembly 190, which couples the drive body 110 and driven body 130 while maintaining them in proximity to each other axially.

Accordingly, a driving device (e.g., an impact bit holder) of an example embodiment, or a torque transfer assembly included in such a driving device, may be provided. The impact bit holder may include a drive body having a drive end configured to interface with a powered driver, and a driven body having a driven end configured to interface with a bit. The drive body includes a base portion. The base portion of the drive body interfaces with a coupling pin that interfaces between the drive body and the driven body at an elastic torque transfer assembly configured to transfer torque between the drive body and the driven body via the coupling pin.

In some embodiments, the bit holder may include additional, optional features, and/or the features described above may be modified or augmented. Some examples of modifications, optional features and augmentations are described below. It should be appreciated that the modifications, optional features and augmentations may each be added alone, or they may be added cumulatively in any desirable combination. In an example embodiment, the base portion may include an axial channel and lateral members extending along opposing sides of the axial channel, and the lateral members may engage the coupling pin. In some cases, each of the lateral members may include a shoulder portion having a groove formed therein, and the groove of each of the lateral members may engage a peripheral edge of the coupling pin. In an example embodiment, the driven body may include a base rod extending in an axial direction and configured to be received in the axial channel, and the coupling pin may extend through a radial channel formed in the base rod. In some cases, a length of the coupling pin may be substantially equal to an outer diameter of the base portion and a socket body of the driven body. In an example embodiment, the radial channel may extend substantially perpendicular to the axial channel, and a diameter of the coupling pin may be less than a diameter of the base rod. In some cases, a retaining ring may be disposed to extend around the coupling pin and the shoulder portion of the each of the lateral members. In an example embodiment, a sleeve may be disposed to extend around an outer periphery of the lateral members and the retaining ring. In some cases, the sleeve may be formed of a resin or composite material. In an example embodiment, the retaining ring may be a continuous ring or a split dowel. In an example embodiment, the retaining ring may define an elastic limit for the elastic torque transfer assembly by defining a maximum amount of axial displacement of the lateral members away from the axial channel.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. An impact bit holder comprising:

a drive body having a drive end configured to interface with a powered driver, the drive body comprising a base portion; and a driven body having a driven end configured to interface with a bit, wherein the base portion of the drive body interfaces with a coupling pin interfacing between the drive body and the driven body as an elastic torque transfer assembly configured to transfer torque between the drive body and the driven body via the coupling pin.

2. The impact bit holder of claim 1, wherein the base portion comprises an axial channel and lateral members extending along opposing sides of the axial channel, and wherein the lateral members engage the coupling pin.

3. The impact bit holder of claim 2, wherein each of the lateral members comprises a shoulder portion having a groove formed therein, and wherein the groove of the each of the lateral members engages a peripheral edge of the coupling pin.

4. The impact bit holder of claim 3, wherein the driven body comprises a base rod extending in an axial direction and configured to be received in the axial channel, and wherein the coupling pin extends through a radial channel formed in the base rod.

5. The impact bit holder of claim 4, wherein a length of the coupling pin is substantially equal to an outer diameter of the base portion and a socket body of the driven body.

6. The impact bit holder of claim 3, wherein the radial channel extends substantially perpendicular to the axial channel, and wherein a diameter of the coupling pin is less than a diameter of the base rod.

7. The impact bit holder of claim 3, wherein a retaining ring is disposed to extend around the coupling pin and the shoulder portion of the each of the lateral members.

8. The impact bit holder of claim 7, wherein a sleeve is disposed to extend around an outer periphery of the lateral members and the retaining ring.

9. The impact bit holder of claim 8, wherein the sleeve comprises a resin or composite material.

10. The impact bit holder of claim 7, wherein the retaining ring comprises a continuous ring or a split dowel.

11. The impact bit holder of claim 7, wherein the retaining ring defines an elastic limit for the elastic torque transfer assembly by defining a maximum amount of axial displacement of the lateral members away from the axial channel.

12. An elastic torque transfer assembly for a bit holder, the elastic torque transfer assembly comprising:

a first lateral member and a second lateral member extending substantially parallel to each other along opposing sides of an axial channel of a base portion of a drive body of the bit holder, the drive body having a drive end configured to interface with a powered driver; and a coupling pin interfacing between the drive body and a driven body of the bit holder to transfer torque between the drive body and the driven body via engagement between the coupling pin and the first and second lateral members.

13. The elastic torque transfer assembly of claim 12, wherein the first and second lateral members each comprises a shoulder portion having a groove formed therein, and wherein the groove of each of the first and second lateral members engages a peripheral edge of the coupling pin.

14. The elastic torque transfer assembly of claim 13, wherein a base rod of the driven body extends in an axial direction and is configured to be received in the axial channel, and wherein the coupling pin extends through a radial channel formed in the base rod.

15. The elastic torque transfer assembly of claim 14, wherein a length of the coupling pin is substantially equal to an outer diameter of the base portion and a socket body of the driven body.

16. The elastic torque transfer assembly of claim 13, wherein the radial channel extends substantially perpendicular to the axial channel, and wherein a diameter of the coupling pin is less than a diameter of the base rod.

17. The elastic torque transfer assembly of claim 13, further comprising a retaining ring disposed to extend around the coupling pin and the shoulder portion of the each of the first and second lateral members.

18. The elastic torque transfer assembly of claim 17, further comprising a sleeve disposed to extend around an outer periphery of the lateral members and the retaining ring.

19. The elastic torque transfer assembly of claim 18, wherein the sleeve comprises a resin or composite material.

20. The elastic torque transfer assembly of claim 17, wherein the retaining ring defines an elastic limit for the elastic torque transfer assembly by defining a maximum amount of axial displacement of the lateral members away from the axial channel.

* * * * *